United States Patent [19]

Townsend

[11] Patent Number: 4,876,958

[45] Date of Patent: Oct. 31, 1989

[54] SWING APPARATUS FOR AN OFFSET PRESS AUXILIARY PRINT UNIT

[75] Inventor: Robert T. Townsend, Altoona, Iowa

[73] Assignee: Townsend Industries, Inc., Altoona, Iowa

[21] Appl. No.: 939,948

[22] Filed: Dec. 9, 1986

[51] Int. Cl.[4] ..... B41F 5/02; B41F 13/12

[52] U.S. Cl. ..... 101/175; 101/177; 101/247

[58] Field of Search ..... 101/177, 175, 136, 137, 101/140, 145, 185, 247, 93.28, 93.14; 414/911, 744 R

[56] References Cited

U.S. PATENT DOCUMENTS

| | | | |
|---|---|---|---|
| 2,845,860 | 8/1958 | Mestre | 101/137 |
| 3,521,559 | 7/1970 | Sejeck et al. | 101/137 |
| 3,611,923 | 10/1971 | Haramia et al. | 101/93.25 |
| 3,876,489 | 4/1975 | Chenel | 414/744 R X |
| 4,111,120 | 9/1978 | Paulson | 101/175 |
| 4,150,621 | 4/1979 | Raible | 101/207 |

*Primary Examiner*—Clifford D. Crowder
*Attorney, Agent, or Firm*—Zarley McKee, Thomte, Voorhees & Sease

[57] ABSTRACT

A swing apparatus for an offset press auxiliary print unit which includes a swing arm detachably mounted on the auxiliary print unit and a vertical support member upon which the arm will pivot through a generally horizontal plane. The swing arm is rotatable and is operably connected to a pair of lifting tines through a parallelogram linkage so as to lift the auxiliary print unit to disengage it from the main press and then swing it horizontally clear of the press. A crank operates a worm gear and sprocket arrangement to rotate the arm and raise or lower the tines. In a second embodiment, a pair of brackets are affixed to a swing arm, and the entire arm is raised and lowered to lift the auxiliary print unit. An electric motor is used to raise and lower the arm.

10 Claims, 4 Drawing Sheets

SWING APPARATUS FOR AN OFFSET PRESS AUXILIARY PRINT UNIT

TECHNICAL FIELD

This invention relates generally to one-color offset presses which have an auxiliary printing unit for converting the press to two-color capabilities, and more particularly to a swing apparatus for engaging and disengaging the auxiliary print unit from the main press.

BACKGROUND OF THE INVENTION

A common feature of conventional offset presses with two-color printing capabilities, is the provision for the disengagement of one of the plate cylinders from the blanket cylinder, so that the user may optionally print using only one color. This allows the disengaged cylinder to remain idle as the one-color printing operation is performed.

One method for disengaging one of the two plate cylinders of a two-color press is demonstrated in the U.S. Pat. No. 2,845,860, to L. Mestre. In that patent the cylinders are moutted in slots within the frame of the press, and each can be shifted slightly so as to disengage the plate cylinder from the blanket cylinder. While this allows the use of the two-color press for one-color projects, it does nothing to simplify the task of cleaning or repairing the cylinders and inking apparatus in the press. Since the plate cylinders and various inking apparatus must be thoroughly cleaned in order to use different colors, it can be seen that it is desirable to provide an apparatus to enable the user to easily reach the cylinders and surrounding structure.

U.S. Pat. No. 3,521,559 to A. W. Sejeck, et al., demonstrates another method for disengaging one of the plate cylinders of a two-color press. The Sejeck device utilizes an auxiliary printing unit which is rockably affixed to the main frame of the conventional one-color press. While the auxiliary head may be "rocked" into a disengaged position, it remains in close proximity to the main frame so that it still remains a difficult task to reach the various cylinders for cleaning or repairs.

The applicant has a patent on an auxiliary print unit for use on a conventional one-color press, thereby creating the capability of the two-color printing. In that patent, U.S. Pat. No. 3,014,421, not only may a single cylinder be disengaged, but the auxiliary printing unit may also be completely removed from the press for repairs and the like. While this device gives complete access to both the main press and the auxiliary printing unit, it typically requires more than one person to remove the unit from the press, and an appropriate location to hold and store the auxiliary unit while removed from the press.

It is therefore an object of the present invention to provide an improved apparatus for disengaging an auxiliary printing unit from a one-color offset press.

Another object of the present invention is to provide a swing apparatus for an auxiliary print unit which allows the unit to be easily disengaged and swung aside by one person.

A further object is to provide a swing apparatus for an auxiliary print unit which will lift and swing the auxiliary unit away from the main unit for complete access to both the auxiliary unit and the main press.

An additional object of the present invention is to provide a swing apparatus which is powered to lift and swing the auxiliary unit from the press.

Still another object of the present invention is to provide a swing apparatus which is easily added to a conventional press having a removable auxiliary print unit.

Still a further object is to provide a swing apparatus which is simple in operation, economical to manufacture, durable in use and refined in appearance.

These and other objects will be apparent to those skilled in the art.

SUMMARY OF THE INVENTION

A swing apparatus for engaging and disengaging an auxiliary print unit from a single-color offset press is disclosed which includes a swing arm detachably mounted to the auxiliary print unit and a vertical support member upon which the arm will pivot through a generally horizontal plane. The swing arm includes a rotatable arm and a rigid parallel rod to which a pair of lifting tines are operably attached so as to lift the auxiliary print unit to disengage it from the main press, and then swing it horizontally, clear of the press. The tines are connected to the arm and parallel rod through a parallelogram linkage which will maintain the tines in a horizontal plane as they are raised and lowered by rotation of the arm. A crank operates a worm gear and sprocket arrangement to rotate the arm and raise or lower the tines.

In a second embodiment, a pair of brackets are affixed to the swing arm, and the entire arm is raised and lowered to lift the auxiliary print unit, and then swung horizontally, clear of the press. An electric motor is used to raise and lower the arm in this embodiment.

DESCRIPTION OF THE PREFERRED EMBODIMENTS

Figure 1:
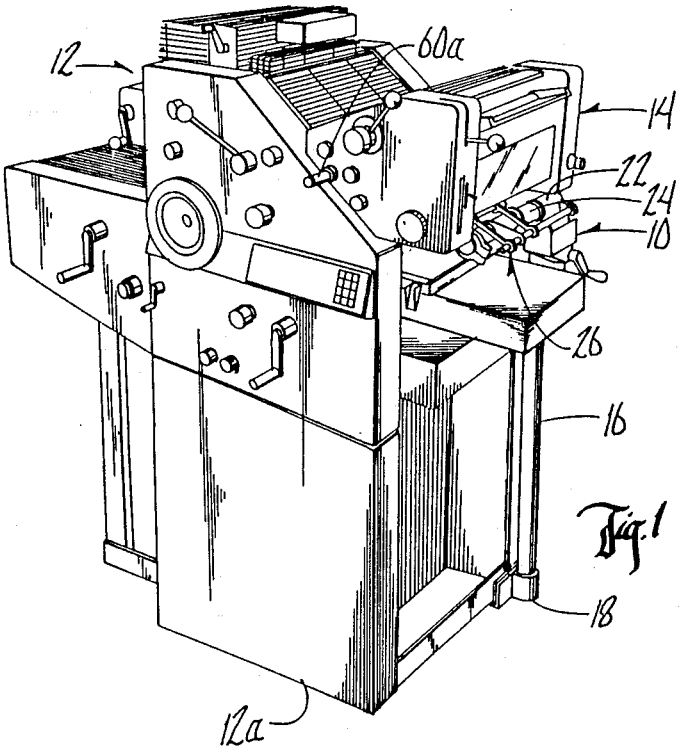
FIG. 1 is a perspective view of a conventional press with the swing apparatus of this invention mounted thereon. An auxiliary print unit is mounted on the swing apparatus and is in an engaged position on the press.

Referring now to the drawings, in which similar or corresponding parts are identified with the same reference numeral, the swing apparatus of this invention is designated generally at 10, and is mounted to a conventional single-color offset press, designated generally at 12, and detachably secured to a second-color auxiliary print unit, designated generally at 14.

Figure 4:
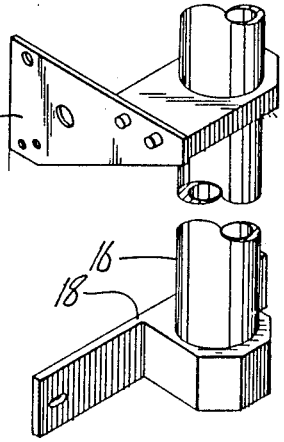
FIG. 4 is an enlarged perspective view of the swing apparatus of this invention.

Swing apparatus 10 includes a vertically-oriented support member 16 mounted to the frame 12*a* of press 12 using lower and upper brackets 18 and 20, respectively, as seen in FIG. 4. A cap 22 is rotatably mounted on the upper end of support member 16, for free rotation about the vertical axis of support member 16. Cap 22 is comprised of a lower vertically-oriented sleeve 22*a* affixed to the underside of an upper horizontally-oriented sleeve 22*b*. Lower sleeve 22*a* is freely rotatable about the vertical axis of support member 16, while upper sleve 22*b* holds an extended cylindrical arm 24. Extended arm 24 is freely rotatable within upper sleeve 22*b* and will swing, along with cap 22, about the vertical axis of support member 16.

A lift assembly, designated generally at 26 in FIG. 4, is attached to arm 24 and cap 22 and is used to lift the auxiliary print unit 14 before swinging it about the vertical axis of support member 16. A pair of brackets 28*a* and 28*b* are clamped to arm 24, perpendiculary to the longitudinal axis thereof, and spaced away from each other. A rod 30 extends between the projecting ends of brackets 28*a* and 28*b*, and is parallel to arm 24.

An elongated rod 32 rigidly extends from cap 22 parallel to arm 24 and supports a pair of pivotal links 34*a* and 34*b*, which project perpendicularly therefrom. An intermediate bracket 36 extends perpendicularly from arm 24, intermediate brackets 28*a* and 28*b*, and holds rod 32 in parallel relation to arm 24.

A pair of lifting tines 38*a* and 38*b* are pivotally attached near their forward ends to rod 30 between brackets 28*a* and 28*b*. The rearward ends of tines 38*a* and 38*b* have a rod 40 fastened therebetween which supports the free end of links 34*a* and 34*b*, to form a parallelogram linkage.

As shown in FIG. 4, rotation of arm 24 within upper sleeve 22*b* will cause brackets 28*a* and 28*b* to rotate as indicated by arrow 42. This, in turn, will cause tines 38*a* and 38*b* to rise upwardly, as links 34*a* and 34*b* pivot about rod 32. Because of this parallelogram linkage, tines 38*a* and 38*b* will stay in a generally horizontal plane as they are raised and lowered.

Figure 3:
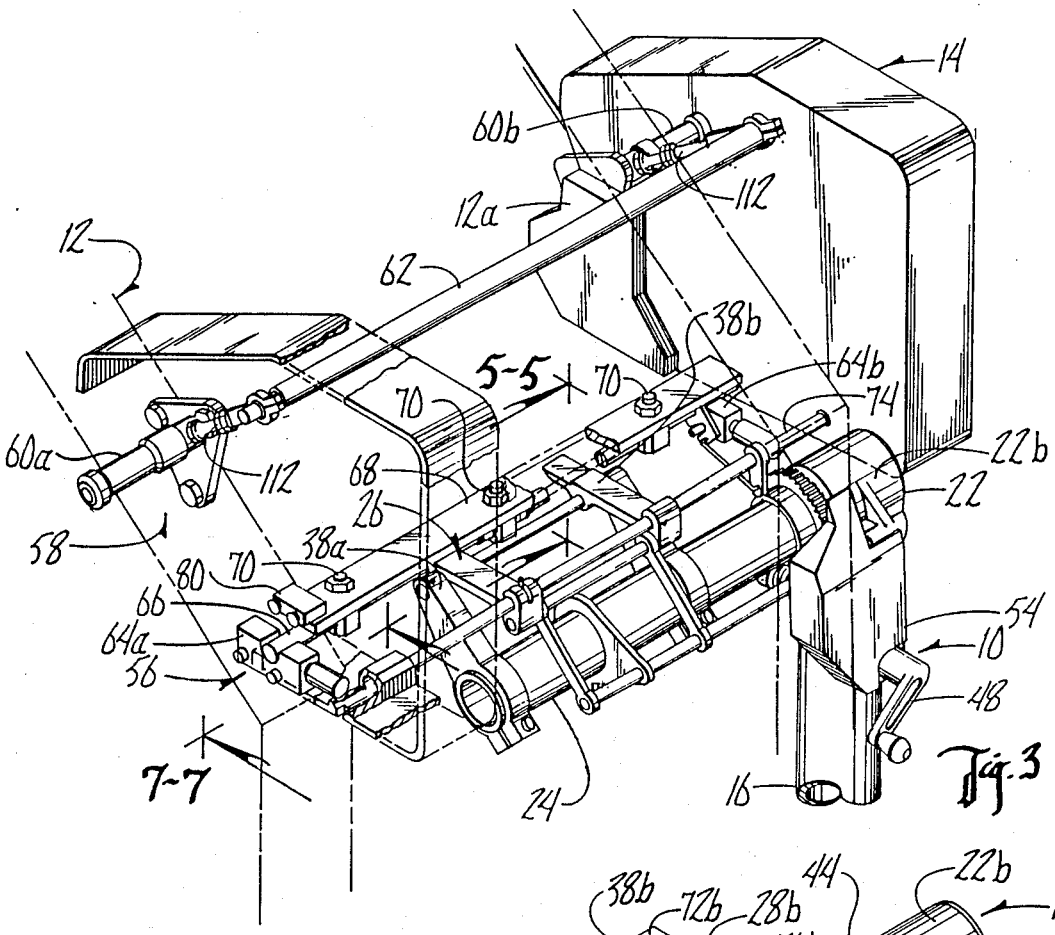
FIG. 3 is an enlarged partial perspective view of the swing apparatus, showing the connection of the swing apparatus to the auxiliary print unit, the auxiliary print unit being in an engaged position on the press.
Figure 5:
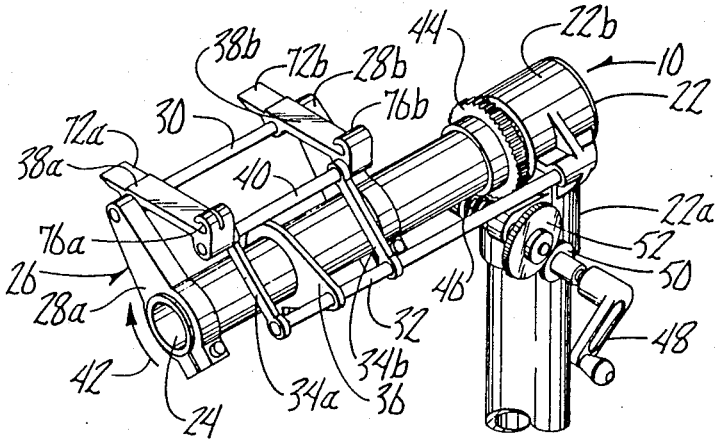
FIG. 5 is a sectional view taken at line 5—5 in FIG. 3.
Figure 5:
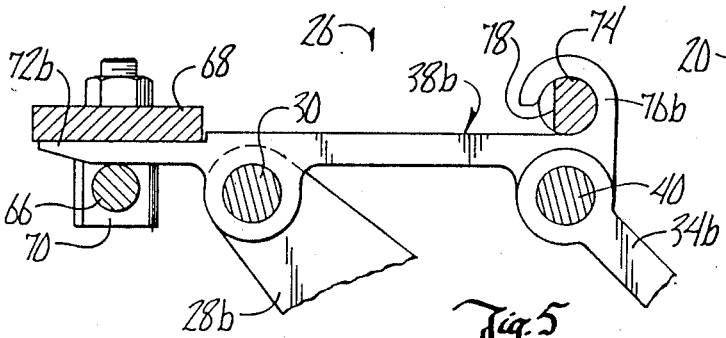

A sprocket 44, affixed axially on arm 24 adjacent cap 22, serves to rotate arm 24 within upper sleeve 22*b*. A worm gear 46 is rotatably mounted on lower sleeve 22*a* of cap 22 such that its teeth mesh with those of sprocket 44. A crank 48 is connected to worm gear 46 through gears 50 and 52 so as to rotate worm gear 46 and thereby rotate sprocket 44 and arm 24. In operation, a cover 54 will enclose gears 50 and 52, as shown in FIG. 3.

Lower and upper adapter assemblies 56 and 58, respectively, are provided for a press 12 and auxiliary print unit 14 which cannot utilize swing apparatus 10 without the addition of corresponding structure.

Upper adapter assembly 58 includes upper locking brackets 60*a* and 60*b* mounted to frame 12*a* on each side of the opening for the attachment of auxiliary print unit 14. Brackets 60*a* and 60*b* will releasably and adjustably lock onto an upper rod 62 attached to auxiliary print unit 14, as seen in FIG. 3 and discussed in more detail below. Lower adapter assembly 56 includes a pair of lower support brackets 64*a* and 64*b* which lock onto a lower rod 66 fastened to the underside of auxiliary print unit 14.

Referring now to FIGS. 3, 5, 7 and 8, it can be seen that lower rod 66 of adapter assembly 56 is mounted below an elongated support strap 68 through a series of spaced bearings 70. Lower rod 66 is mounted in spaced relation from strap 68 so that the forward ends 72*a* and 72*b* of tines 38*a* and 38*b* will fit snugly therebetween. A rotatable cylindrical locking bar 74 is mounted parallel to strap 68 and horizontally spaced therefrom on auxiliary print unit 14, so as to fit into hook portions 76*a* and 76*b* at the rearward end of tines 38*a* and 38*b*. Hook portions 76*a* and 76*b* have an access opening less than the diameter of bar 74, so that flattened portions 78 on bar 74 must be rotated to a horizontal orientation in order to fit into these hooked portions 76*a* and 76*b*.

In order to lift auxiliary print unit 14 from its engaged position, locking bar 74 must first be rotated to a position with its flat portion 78 horizontal. Then, tines 38*a* and 38*b* are slid into the space between strap 68 and rod 66, with hook portions 76*a* and 76*b* snugly fitting onto bar 74. Bar 74 may then be rotated to lock the tines 38*a* and 38*b* in position. Crank 48 is then operated to lift tines 38*a* and 38*b*, and thus auxiliary print unit 14. The auxiliary print unit 14 may then be swung horizontally away from press 12.

Figure 7:
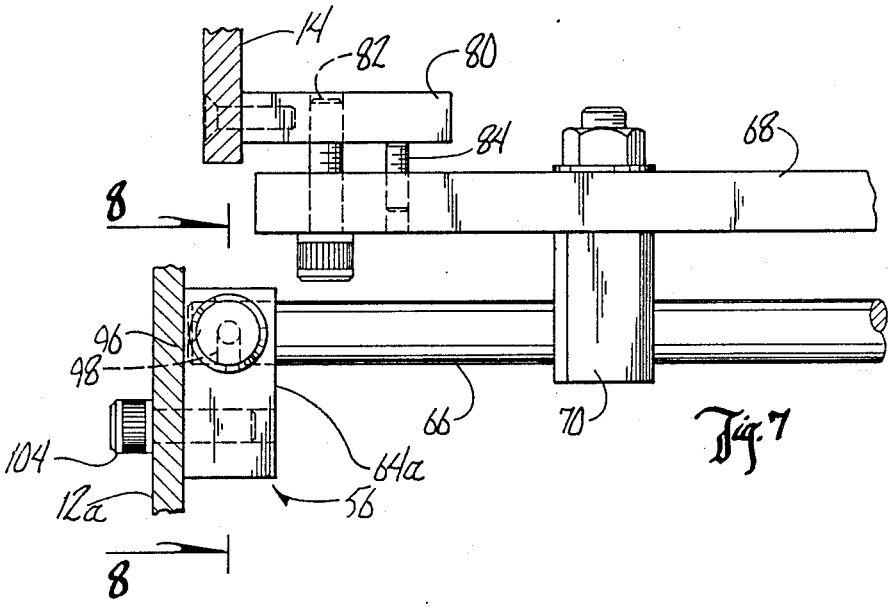
FIG. 7 is a sectional view taken at line 7—7 in FIG. 3.
Figure 8:
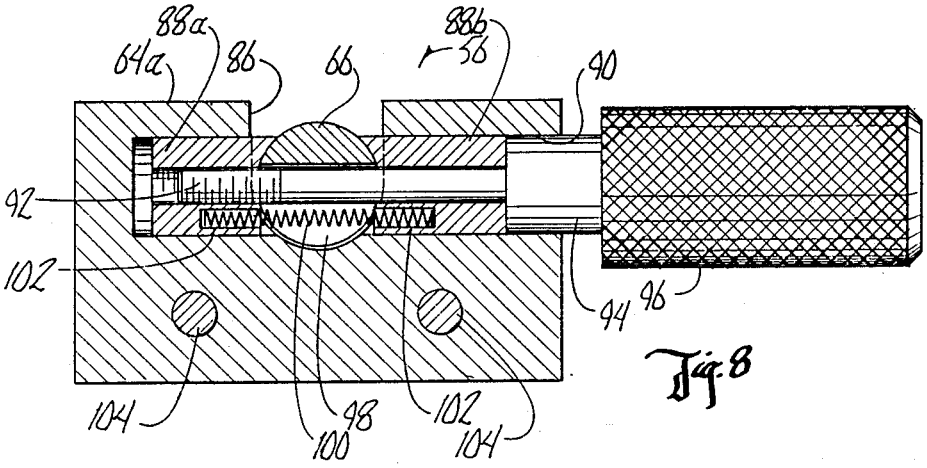
FIG. 8 is a sectional view taken at line 8—8 in FIG. 7.

FIGS. 7 and 8 show additional detail of the detachable connection of the auxiliary print unit 14 to the lower support bracket 64*a*. A vertical adjustment mechanism 80 is mounted to the frame of the auxiliary print unit 14 and supports the unit 14 on one end of strap 68. A guide screw 82 and vertical adjustment screw 84 cooperate to allow for the vertical adjustment of one end of auxiliary print unit 14, for alignment with press 12 in a conventional manner.

Lower brackets 64*a* and 64*b* each include a slot 86 in the upper edge which will receive rod 66. A pair of clamping members 88*a* and 88*b* are inserted in an aperture 90 on opposite sides of slot 86 and pependicular thereto, and are shaped to cooperatively clamp onto rod 66, as shown in FIG. 8. A bolt 92 is threaded into one clamping member 88*a*, and slidably projects through the other clamping member 88*b*. Bolt 92 has a head 94 and knurled knob 96 attached to head 94, such that rotation of the knob 96 will cause the threaded clamping member 88*a* to clamp against rod 66, and also pull head 94 against clamping member 88*b* to simultaneously clamp against the opposite side of rod 66. Rod 66 has channel 98 in its lower side to allow rod 66 to slide over bolt 92 into slot 86. A coil spring 100 is arranged in compression between opposing apertures 102 in clamping members 88*a* and 88*b* so as to urge them apart upon opposite rotation of knob 96—thereby releasing rod 66.

Lower brackets 64*a* and 64*b* may be added to frame 12*a* of press 12 by fastening them through existing apertures using bolts 104, or the like.

Figure 2:
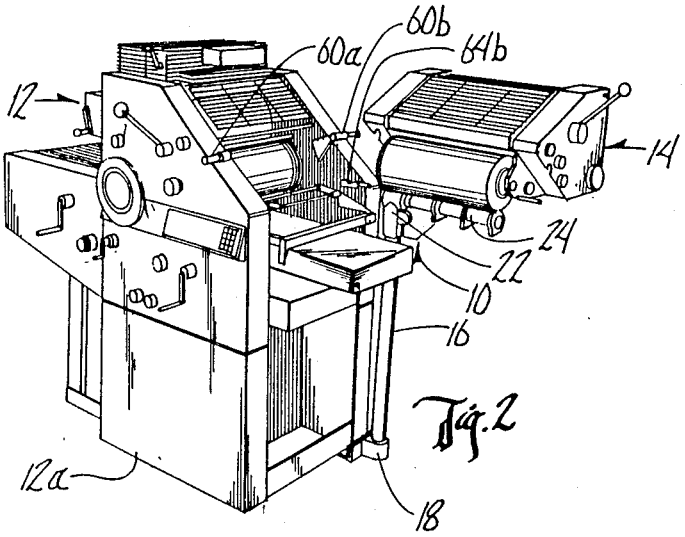
FIG. 2 is a perspective view of the press of FIG. 1, but with the auxiliary print unit swung outwardly on the swing apparatus in a disengaged position from the press.
Figure 6:
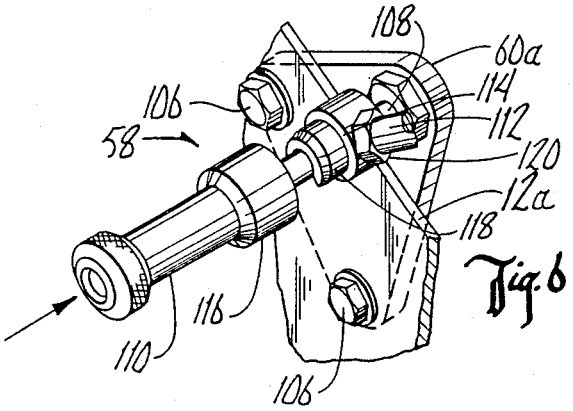
FIG. 6 is an enlarged perspective view of a support bracket of the invention mounted to the frame of the press.

Upper brackets 60*a* and 60*b*, as shown in FIGS. 2, 3 and 6, are detachably secured to frame 12*a* using bolts 106, or the like. Since brackets 60*a* and 60*b* are alike, only one will be described herein. An elongated pin 108, extends through bracket 60*a* and has an adjustable end-sleeve 110 which may be threaded thereon. Upper rod 62 is adjustably locked to pin 108 via a turnbuckle 112.

Turnbuckle 112 has one end clamped to rod 62, and the other end detachably secured to pin 108 on bracket 60*a*.

A shackle 114 attached to the turnbuckle 112 fits the shank of pin 108. An enlarged portion 116 of end-sleeve 110 will slide over and surround the smaller diameter end portion 118 of shackle 114. Thus, by threading end-sleeve 110 onto pin 108 while the shackle 114 of turnbuckle 112 is fitted onto pin 108, turnbuckle 112 is locked into position on bracket 60*a*. The length of turnbuckle 112 may be adjusted in a conventional manner by rotating a nut 120.

In operation, the auxiliary print unit 14 may be quickly and easily released from the main press 12 using the swing apparatus 10 of this invention. First, tines 38*a* and 38*b* are adjusted to the correct height, inserted between strap 68 and rod 66, and locked in place by rotating bar 74 within hook portions 76*a* and 76*b*, as described above. The auxiliary print unit's connection to upper brackets 60*a* and 60*b* is quickly released by releasing end-sleeve 110 from its locking position surrounding the end portion 118 of shackle 114. This releases turnbuckle 112 from pin 108. The final connection to the main press 12 is at rod 66 in lower brackets 64*a* and 64*b*. Rod 66 is released by rotating knurled knob 96 to release the clamping members 88*a* and 88*b* clamped around rod 66. Then, crank 48 is cranked to raise auxiliary print unit 14 slightly, so that rod 66 will rise out of slot 86 in lower brackets 64*a* and 64*b*, and turnbuckles 112 will be removed from pin 108. After being raised, the entire auxiliary print unit 14 may be swung horizontally away from press 12, about the vertical axis of support member 16. Auxiliary print unit 14 may be quickly and easily re-engaged by reversing this procedure.

Figure 9:
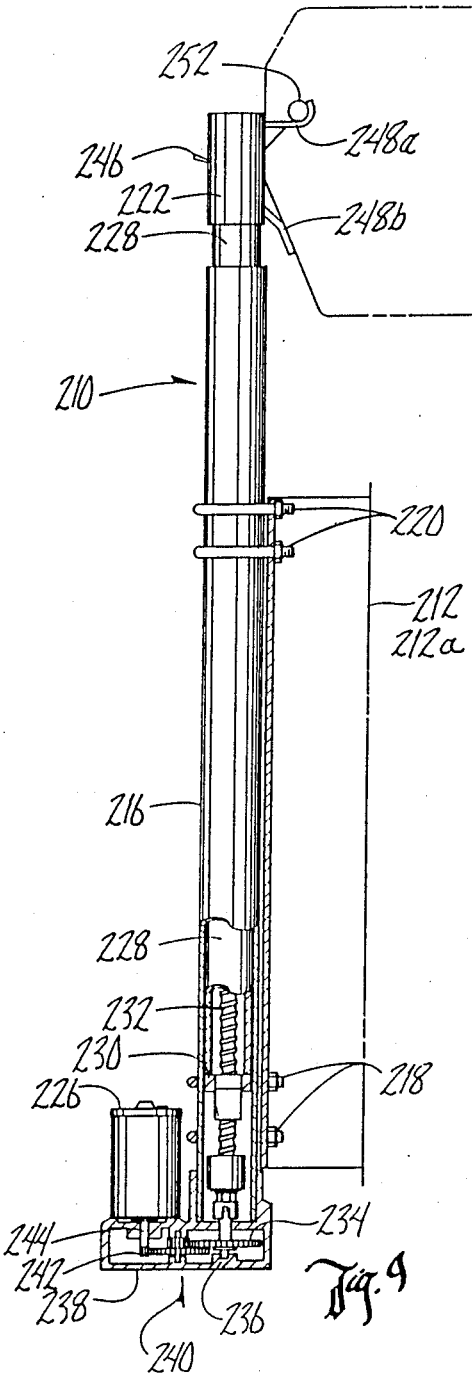
FIG. 9 is a side elevational view of another embodiment of the invention, with a portion shown in sectional view.
Figure 10:
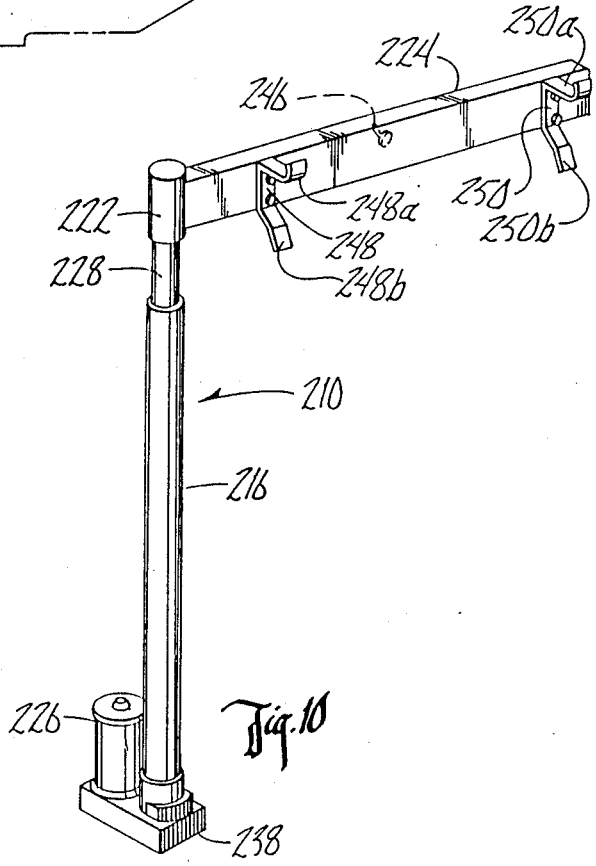
FIG. 10 is a perspective view of the embodiment of FIG. 9.

Another embodiment of the present invention is shown in FIGS. 9 and 10. Swing apparatus 210 is powered by an electric motor 226. Swing apparatus 210 is mounted to the frame 212*a* of a conventional offset press 212, with an auxiliary print unit 214 detachably mounted thereon. A vertical lower support member 216 is fastened to press frame 212*a* via a lower bracket 218 and upper bracket 220. Cap 222 with extended arm 224 projecting outwardly therefrom, is mounted on a vertical sleeve 228 which is slidably received within lower support member 216. Sleeve 228 is freely rotatable within support member 216 such that arm 224 will easily swing about the vertical axis of support member 216.

The lower end of sleeve 228 is mounted to a guide member 230 which is slidably received within support member 216, and threaded to engage a vertical threaded rod 232 within sleeve 228. Threaded rod 232 is rotatable within sleeve 228 and is axially mounted to a sprocket 234. Sprocket 234 is mounted on a bearing 236 in a housing 238. Sprocket 234 is driven via a series of gears 240 which intermesh with a drive gear 242 affixed to the rotating drive shaft 244 projecting from electric motor 226.

It can be seen that motor 226 will drive the threaded rod 232, causing guide 230 and sleeve 228 to move upwardly or downwardly along rod 232. An electric switch 246 is used to activate motor 226, as necessary.

A pair of support brackets 248 and 250 project perpendicularly from arm 224, and are used to lift auxiliary print unit 214. Each bracket 248 and 250 has an upper portion 248*a* and 250*a* which extends horizontally and has an upturned end. Upper portions 248*a* and 250*a* will lift a rod 252 mounted on auxiliary print unit 214, the upturned ends hooking onto rod 252. Each bracket 248 and 250 also has a lower portion 248*b* and 250*b* which extends outward and downward so as to bear against auxiliary print unit 214 as it pivots on rod 252.

In operation, arm 224 is swung about the vertical axis of support member 216 to a position where brackets 248 and 250 are below rod 252 on auxiliary print unit 214. Switch 246 is then flipped to activate motor 226 and raise arm 224. After lifting auxiliary print unit 214, thereby disengaging it from main press 212, the print unit 214 is easily rotated about the axis of support member 216 to a position away from press 212, allowing easy cleaning and repair.

It can therefore be seen that the present invention fulfills at least all of the objectives described above.

I claim:

1. In combination, a single-color offset printing press having a frame and single-color printing means, a second-color auxiliary print unit removably mounted on said frame in operative engagement with said single-color printing means, and a swing apparatus for selectively engaging and disengaging said auxiliary print unit from said press, the swing apparatus comprising:

swingable support means pivotally mounted on said frame for pivotal movement about a vertical axis, securing means on said support means for detachably securing said support means to said auxiliary print unit; and said support means including lift means to lift said auxilliary print unit out of engagement with said single-color printing means, whereby said auxiliary print unit can be lifted and then pivoted in a substantially horizontal plane from its operative position on said press to an inoperative position laterally adjacent said press.

2. The swing apparatus of claim 1, wherein said support means includes a generally vertical support member mounted on said frame and a generally horizontal arm pivotally connected at one end to said support member for pivotal movement in a substantially horizontal plane.

3. The swing apparatus of claim 2, wherein said arm is further mounted for rotatable movement about its own axis;

wherein a plurality of tines within the same horizontal plane are operably connected to said arm, said tines adapted to raise and lower with respect to said arm upon the rotation of said arm about its axis; and further comprising means for selectively rotating said arm about its axis.

4. The swing apparatus of claim 3, wherein said means for selectively rotating said arm includes:

a sprocket axially mounted on said arm;

a worm gear rotatably mounted on said vertical support member in engagement with said sprocket; and a crank operably connected to said worm gear for rotating said worm gear and thereby rotating said sprocket and said arm.

5. The swing apparatus of claim 3, wherein said lift means further includes:

a rigid rod mounted parallel to said arm and adapted to swing therewith about said vertical axis; and parallelogram linkage means operably connecting said tines, arm and rod, such that the tines will be raised and lowered in a substantially horizontal plane.

6. The swing apparatus of claim 2, wherein said arm includes a vertical sleeve depending from its pivotal end and rotatably and slidably mounted in said vertical support member so as to pivot said arm by rotating on its axis, said sleeve adapted to raise and lower said arm in relation to said vertical support member by sliding upwardly and downwardly within said support member.

7. The swing apparatus of claim 6, wherein the vertical movement of said sleeve is powered by an electric motor, said sleeve being selectively moved upwardly and downwardly by energizing said motor.

8. The swing apparatus of claim 6 wherein said lift means includes a threaded guide member on a lower end of said sleeve and a rotatable threaded shaft matingly received within said guide member, such that rotation of said shaft in one direction raises said guide member, sleeve and arm and rotation of said shaft in the opposite direction lowers said guide member, sleeve and arm.

9. The swing apparatus of claim 8 further comprising an electric motor operatively connected to said shaft for imparting rotation to said shaft.

10. The swing apparatus of claim 1 wherein said securing means includes hook means for receiving and engaging a corresponding portion of said auxiliary print unit.

* * * * *